US008667682B2

(12) United States Patent
Lee et al.

(10) Patent No.: US 8,667,682 B2
(45) Date of Patent: Mar. 11, 2014

(54) METHOD OF FABRICATING A NEARWALL NOZZLE IMPINGEMENT COOLED COMPONENT FOR AN INTERNAL COMBUSTION ENGINE

(75) Inventors: Ching-Pang Lee, Cincinnati, OH (US); Jay A. Morrison, Titusville, FL (US)

(73) Assignee: Siemens Energy, Inc., Orlando, FL (US)

( * ) Notice: Subject to any disclaimer, the term of this patent is extended or adjusted under 35 U.S.C. 154(b) by 513 days.

(21) Appl. No.: 13/094,966

(22) Filed: Apr. 27, 2011

(65) Prior Publication Data

US 2012/0272521 A1 Nov. 1, 2012

(51) Int. Cl.
*B21D 53/00* (2006.01)

(52) U.S. Cl.
USPC ..... 29/890.01; 60/39.01

(58) Field of Classification Search
USPC ..... 29/890.01; 60/39.01; 165/47
See application file for complete search history.

(56) References Cited

U.S. PATENT DOCUMENTS

| | | | | |
|---|---|---|---|---|
| 4,077,205 | A | 3/1978 | Pane et al. | |
| 4,118,146 | A | 10/1978 | Dierberger | |
| 4,158,949 | A | 6/1979 | Reider | |
| 4,315,406 | A | 2/1982 | Bhangu et al. | |
| 4,887,663 | A * | 12/1989 | Auxier et al. | 165/47 |
| 5,265,409 | A | 11/1993 | Smith, Jr. et al. | |
| 5,363,654 | A | 11/1994 | Lee | |
| 5,435,139 | A | 7/1995 | Pidcock et al. | |
| 5,467,815 | A | 11/1995 | Haumann et al. | |
| 5,586,866 | A | 12/1996 | Wettstein | |
| 5,596,870 | A | 1/1997 | Dillard et al. | |
| 5,782,294 | A | 7/1998 | Froemming et al. | |
| 6,000,908 | A | 12/1999 | Bunker | |
| 6,237,344 | B1 | 5/2001 | Lee | |
| 6,439,846 | B1 | 8/2002 | Anderson et al. | |
| 6,837,050 | B2 | 1/2005 | Mandai et al. | |
| 7,219,498 | B2 | 5/2007 | Hadder | |
| 7,375,962 | B2 | 5/2008 | Campbell et al. | |
| 7,581,385 | B2 | 9/2009 | Farah et al. | |
| 2005/0022531 | A1 | 2/2005 | Burd | |
| 2006/0005543 | A1 | 1/2006 | Burd | |
| 2006/0130484 | A1 | 6/2006 | Marcum et al. | |
| 2006/0185345 | A1 | 8/2006 | Wilson et al. | |
| 2007/0180827 | A1 | 8/2007 | Dawson et al. | |
| 2008/0276619 | A1 | 11/2008 | Chopra et al. | |
| 2010/0071382 | A1 | 3/2010 | Liang | |
| 2010/0077719 | A1 | 4/2010 | Wilson et al. | |

* cited by examiner

*Primary Examiner* — Richard Chang

(57) ABSTRACT

A method of forming an internal combustion engine component having a multi-panel outer wall. The multi-panel outer wall has an inner panel (16) with an inner surface (18) and an outer surface (37). The inner panel outer surface (37) has discrete pockets (23) formed by integral structural ribs (38). Each pocket (23) has a film cooling hole (31) between the pocket (23) and the plenum (20). The method includes: forming dimples (40) in the intermediate panel (22), at least one dimple (40) having a nozzle (29); securing the intermediate panel (22) to the inner panel outer surface (37), thereby enclosing at least one pocket (23); and ensuring a respective dimple (40) having a nozzle (29) protrudes into a respective enclosed pocket (24) and a respective nozzle (29) is configured to direct a respective jet (35) of cooling fluid onto the inner panel outer surface within the respective enclosed pocket (23).

20 Claims, 2 Drawing Sheets

METHOD OF FABRICATING A NEARWALL NOZZLE IMPINGEMENT COOLED COMPONENT FOR AN INTERNAL COMBUSTION ENGINE

FIELD OF THE INVENTION

This invention is directed generally to internal combustion engines and, more particularly, to components useful for routing hot gasses. More specifically, the invention relates to methods of forming and assembling multi-panel walls having complex geometric contoured outer surfaces.

BACKGROUND OF THE INVENTION

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine components to these high temperatures. As a result, turbine components must be made of materials capable of withstanding such high temperatures. Turbine blades, vanes, transitions and other components often contain cooling systems for prolonging the life of these items and reducing the likelihood of failure as a result of excessive temperatures. However, a desire to increase operating temperatures and other changes in turbine technology leave room for improvement in the art.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
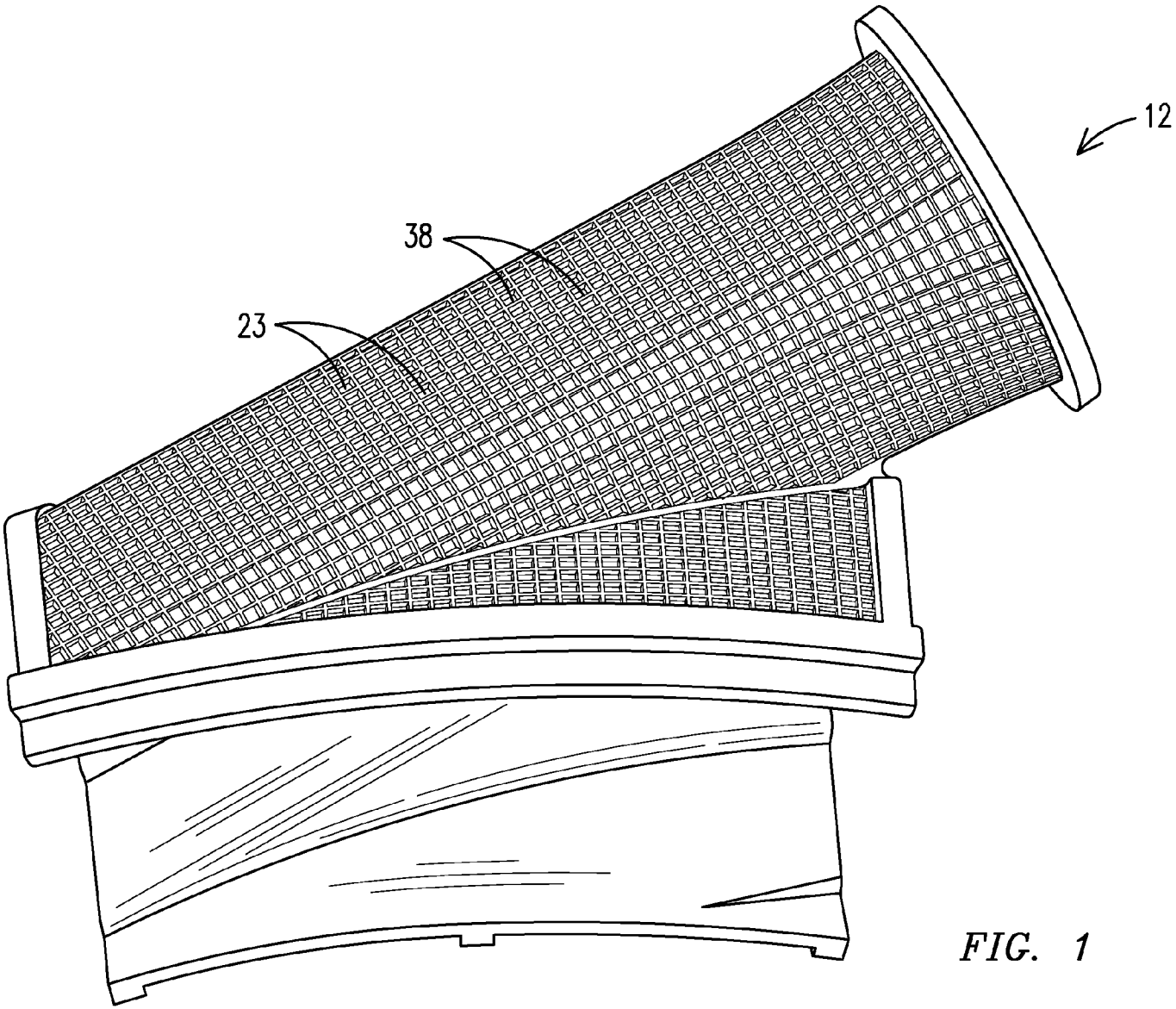
FIG. 1 is a perspective view of a turbine engine component with only the inner panel shown.

The inventors have devised an innovative, simple, inexpensive, and easy to manufacture method for forming a cooling system for an internal engine component exposed to a hot gas path. The cooling system may be configured for use with any component in contact with the hot gas path of an internal combustion engine, such as a component defining the hot gas path of a turbine engine. The method is useful for components that are used under high thermally stressed conditions and having complex outer surface contours. One such component is a transition duct, and others include vane platforms, ring segments (blade outer air seals), combustor liners, etc. The transition duct may be configured to route gas flow in a combustion turbine subsystem that includes a first stage blade array having a plurality of blades extending in a radial direction from a rotor assembly for rotation in a circumferential direction, said circumferential direction having a tangential direction component, an axis of the rotor assembly defining a longitudinal direction, and at least one combustor located longitudinally upstream of the first stage blade array and may be located radially outboard of the first stage blade array. The transition duct may include a transition duct body having an internal passage extending between an inlet and an outlet.

The cooling system formed from a three-layered system is particularly beneficial for a modular transvane concept, as described in co-pending U.S. patent application Ser. No. 12/420,149 (publication number US 2010/0077719) incorporated herein by reference, where the hot gas flow is accelerated to a high Mach number, and the pressure drop across the wall is much higher than in traditional transition ducts. This high pressure drop is not ideal for desired film cooling, and an impingement panel alone may be insufficient to reduce the post-impingement air pressure for ideal film cooling effectiveness. Therefore, the outer panel, which serves primarily as a pressure drop/flow metering device, may be especially beneficial in a component in the Nova-Duct concept.

In one embodiment, the transition duct may have a multi-panel outer wall formed from an inner panel having an inner surface that defines at least a portion of a hot gas path plenum and an intermediate panel positioned radially outward from the inner panel such that one or more cooling chambers is formed between the inner and intermediate panels. The intermediate panel may cover all or part of the inner panel. In another embodiment, the transition duct may include an inner panel, an intermediate panel and an outer panel. The inner, intermediate and outer panels may include one or more holes for passing cooling fluids between cooling chambers for cooling the panels. The intermediate and outer panels may be secured with an attachment system coupling the intermediate panels to the inner panel such that the intermediate and outer panels may move in-plane. However, the intermediate panels may be welded to the inner panel or attached by any means known to those of ordinary skill in the art. The outer panel may cover all or part of the intermediate panel and likewise may be welded to the inner panel or attached by an attachment system or any means known to those of ordinary skill in the art. The cooling system may include one or more metering holes to control the flow of cooling fluids into the cooling chambers. In particular, the outer panel may include a plurality of metering holes. The intermediate panel may include one or more impingement holes, and the inner panel may include one or more film cooling holes.

The method comprises providing a component to be incorporated in an internal combustion engine and having an inner panel having an outer surface with an array of interconnected ribs forming discrete pockets disposed on the outer surface. Dimples are formed on an intermediate panel and at least one dimple corresponds to a discrete pocket on the inner panel. Each dimple may have a nozzle through which a cooling fluid may flow. The intermediate panel may be bent to form a contour that matches a contour of the inner panel, either before it is applied to the inner panel or as it is applied to the inner panel. The intermediate panel may be secured to the inner panel by known techniques, including welding or by using a fastening system. More specifically, the intermediate panels may be affixed to the ribs of the inner panel at sections of the intermediate panel between dimples, (a.k.a. unindented portions). There may be one or more dimples per discrete pocket, and there may be no dimple in a discrete pocket.

An outer panel configured to meter flow through the dimple may be secured to the intermediate panel and may cover some or all of the intermediate panel. The outer panel may have flow regulating holes there through and these holes may correspond to the dimples on the intermediate panel. In an embodiment there may be at least one flow-metering hole associated with a dimple. The outer panel may be formed to a contour of the intermediate panel either before or when it is secured to the intermediate panel. The outer panel may be secured to the intermediate panel by known techniques, including welding or by using a fastening system.

Figure 2:
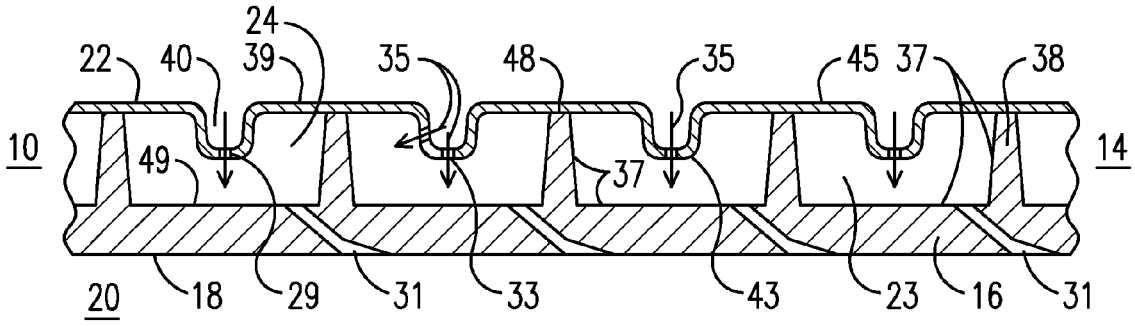
FIG. 2 is a cross section of a turbine engine component with an intermediate panel.

Turning to the drawings, FIG. 1 shows a cross section of a transition duct 12 with an inner panel having a plurality of discrete pockets 23 formed by ribs 38. As can be seen in FIG. 2, the inner panel 16 has an inner surface 18 that defines at least a portion of a hot gas path plenum 20. The inner panel 16 may have a generally conical, cylindrical shape, may be an elongated tube with a substantially rectangular cross-sectional area referred to as a Nova Duct, in which a transition section and a first row of vanes are coupled together, or another appropriate configuration.

The ribs 38 may provide structural support for the inner panel 16 and any other panels. The rib 38 may have a generally rectangular cross-section, a generally tapered cross-section, or any other appropriate configuration. The tapered cross-section may be configured such that a cross-sectional area of the rib 38 at the base is larger than a cross-sectional area of the rib 38 at an outer tip 48. The benefits of a tapered rib 38 include improved casting properties, such as, but not limited to, mold filling and solidification, removal of shell, etc., and better fin efficiency which reduces thermal stresses. Tapering the ribs 38 makes for a more uniform temperature distribution and less thermal stress between the cold ribs and the hot pocket surface. Further, the ribs 38 may have differing heights from the inner panel 16. The ribs 38 may be aligned with each other. Some of the ribs 38 may be aligned in a first direction and some of the ribs 38 may be aligned in a second direction that is generally orthogonal to the first direction. In another embodiment, a triangular shaped structure or honeycomb shaped structure may also be used. The rib 38 spacing, height, width, and shape may vary from one part of the component to another. The inner panel 16 may include one or more film cooling holes 31 through which cooling fluid may flow inwardly through the inner panel 16 and into the plenum 20 to form film cooling on the inner surface 18 of the inner panel 16. One or more of the film cooling holes 31 in the inner panel 16 may be positioned non-orthogonally relative to the inner surface 18 of the inner panel 16.

The pockets themselves may have any dimensions. The method disclosed herein is advantageous for smaller pockets, for example pockets with a rib-to-opposing-rib dimension of 20 mm or less, with tall ribs 38, such as 6 mm or more, where it would be difficult to deep-draw sheet material in place. However, such dimensions are not meant to be limiting and the disclosure is directed toward pockets with larger dimensions as well.

An intermediate panel 22 may be positioned outward from the inner panel 16 such that one or more cooling chambers 24 is formed between the inner panel 16 and intermediate panel 22. The intermediate panel 22 includes a depression 40 (a.k.a. a dimple, or a deformation) for situations where the intermediate panel 22 needs to be closer to the inner panel 16 for optimal impingement because the height of the ribs 38 is larger than the optimal height. The depressions 40 may be positioned between adjacent ribs 38 such that a volume of the cooling chamber 24 between the inner panel 16 and the intermediate panel 22 is reduced when compared with a linear intermediate panel 22. The intermediate panel 22 may enclose all, or less than all of the pockets 23 on the inner panel. There may be a deformation 40 for each pocket 23, or there may not be a deformation 40 for each pocket 23, even if the pocket 23 is enclosed.

Each deformation 40 may include one or more impingement holes 29 (a.k.a. nozzles), each having an impingement hole outlet 33. However, it is foreseeable that a dimple may not have any impingement hole 29. This may be the case if the deformation 40 serves another purpose, such as a positioned or spacer etc. In an embodiment the impingement holes 29 are configured to direct a jet 35 of cooling fluid onto a portion of the inner panel outer surface 37 within the pocket 23. In another embodiment the impingement holes 29 may be configured to direct a jet 35 of cooling fluid onto an inter-rib portion 49 of the inner panel outer surface 37 of that pocket that is between the ribs 38 of that pocket 23. In yet another embodiment the impingement holes 29 may be configured to direct a jet 35 of cooling fluid into a corner of the pocket 23, such as the location where the ribs 23 originate.

The distance of the impingement hole outlet 33 to the inner panel outer surface 37 is controlled by a magnitude of the deformation, and a location of the impingement hole outlet 33 on the deformation 40, and thus the deformation 40 may be configured to produce an optimal jet 35 of cooling fluid. The impingement hole outlet 33 may be disposed on the deformation 40 closest to a point where the jet 35 impinges the inner panel outer surface 37, or it may be disposed farther away by virtue of angling the impingement hole 29 through the deformation 40 at an angle at other than orthogonal to the deformation 40. In an embodiment the impingement hole outlet 33 is closer to the inner panel outer surface 37 than it is to an undeformed portion 39 (i.e. a linear portion of the panel) of the intermediate panel 22 (i.e. the portion without any depressions 40).

The configuration of the deformation 40 and impingement hole outlet 33 may differ to optimize the impingement cooling. For example, the deformation 40 may be positioned in a center of the pocket 23 and the impingement hole outlet 33 be at a deformation tip 43 closest to the inter-rib portion 49 and direct the jet 35 essentially orthogonal to the inter-rib portion 49. Alternately, the deformation 40 may not be centered but instead closer to a rib 38, or adjacent a rib 38, and/or the impingement hole outlet 33 may direct the jet 35 to the inner panel outer surface 37 at an angle other than orthogonal, or may direct the jet 35 into a corner etc.

Figure 3:
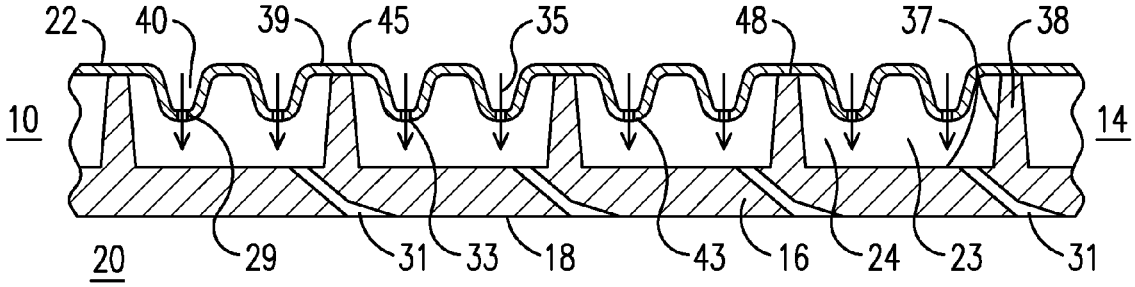
FIG. 3 is an alternate embodiment of the turbine engine component of FIG. 2.

The intermediate panel 22 may be supported by the ribs 38 and may contact the ribs 38. The undeformed portion 39 of the intermediate panel 22 may contact the rib 38 at a rib outer tip 48, thereby enclosing the pocket 23 and forming the cooling chamber 24. All or less than all of the pockets 23 may be enclosed by the intermediate panel 22. As seen in FIG. 3, there may be a plurality of deformations for each pocket 23, and consequently a plurality of jets 35 for each pocket 23. The intermediate panel 22 may be welded to the ribs 38, or secured with a fastening system known to those in the art. It may be desirable to fix the intermediate panel 22 to the inner panel 16 as little as possible. I.e. it may be desirable to minimize fixity between the two for reasons of thermal stress. During operation the intermediate panel 22 may be cooler than the inner panel 16. The more the intermediate panel 22 is fixed to the inner panel 16, the greater the thermal stress/fight between the two. In an embodiment the intermediate panel 22 may be welded to the inner panel 16 at a minimum number of locations sufficient to prevent gross movement of the intermediate panel 22 with respect to the inner panel 16. This allows for the intermediate panel 22 to flex and otherwise adjust to accommodate relative changes between the inner panel 16 and the intermediate panel 22. In an embodiment the minimum number of welds may also reduce intermediate panel 22 vibrations. The degree of fixity required may also consider the pressure difference across the intermediate panel 22. The greater pressure outside the panels may aid in holding the panels in place.

Depending on how the intermediate panel 22 is secured to the ribs 38 a pocket 23 may be hermetically sealed from adjacent pockets, or may not be. For example, if an outer tip 48 of the intermediate panel 22 is secured to the undeformed portion 39 around an entire perimeter of the pocket 23, then the pocket will be hermetically sealed from adjacent pockets. In other embodiments portions of the outer tip 48 of the ribs around the perimeter of the pocket may not be in secured to the undeformed portion 39, and in such embodiments a pocket 23 may not be hermetically isolated from an adjacent pocket 23. In embodiments where a pocket 23 is not hermetically sealed from adjacent pockets, and where a pressure variation along the flow path (i.e. from an pocket to pocket) is minimal, leakage from pocket 23 to pocket 23 may be negligible and of little concern and so hermetically sealing a pocket would be unnecessary. In regions where pressure varies along the flow path each pocket could be hermetically sealed, or alternately, segments comprising groups of pockets could be sealed from other segments.

The intermediate panel 22 may be formed from a flat sheet of material. Deformations may be made in the sheet in a pattern known to match a pattern of the pockets 23 on the component to which it will be secured. In an embodiment the deformations 40 may be patterned so that they will be disposed at approximately the center of the pocket 23. However, the deformations 40 may be disposed at other locations in the pocket 23, or some may be centered, and some not etc. This is true for a single pocket 23, such that one deformation 40 may be centered and one not within the same pocket 23. This also applies pocket 23 to pocket 23, where there may be some pockets 23 with centered deformations 40 and some where the deformations 40 are not centered. Any pattern is acceptable so long as it accomplishes the required cooling effect. The impingement holes 29 may be formed prior to forming the deformations 40, during, or after. They may be formed by various methods known to those in the art. They may be patterned to be disposed at the deformation tip 43, or may be somewhere between the extreme end and the undeformed portion 39 of the intermediate panel 22, and may be omitted from select dimples 23. They may be orthogonal to the portion of the deformation 40 through which they traverse, or they may be at an angle other than orthogonal as necessary. The intermediate panel 22 may be formed to a contour of the inner panel 16 as it is secured to the inner panel 16.

The intermediate panel 22 may alternately be bent prior to being secured to the inner panel 16. This may occur prior to or after forming the deformations and/or the impingement holes 29. The intermediate panel may be bent to match a contour of the inner panel 16 in order to simplify the step of securing the intermediate panel 22 to the inner panel 16.

Figure 4:
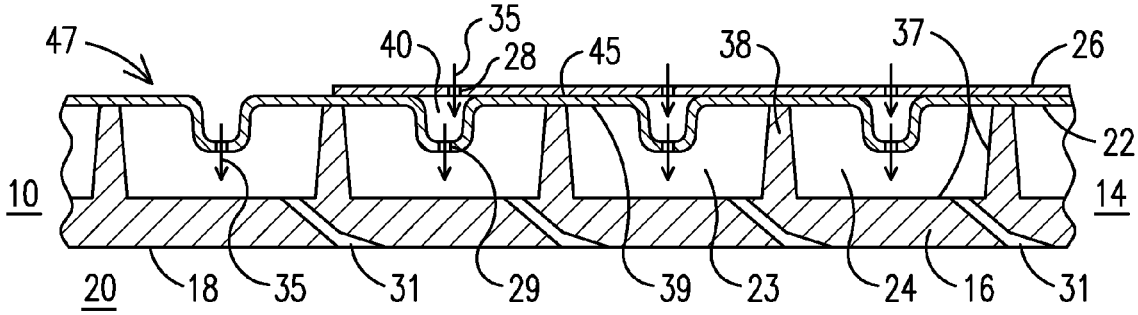
FIG. 4 is a cross section of a turbine engine component of FIG. 2 with an outer panel.

The transition duct 12 may also include an outer panel 26 secured to an intermediate panel undeformed portion outer surface 45, as shown in FIG. 4. Alternately, the outer panel 26 may be set-off a distance from the intermediate panel 22. If secured to the intermediate panel undeformed portion outer surface 45, the outer panel 26 may enclose all of the deformations 40. Alternately, the outer panel 26 may not span all of the deformations 40 and thus may enclose only some of them, leaving a region 47 of unenclosed deformations 40. Similar to the intermediate panel 22, minimizing fixity of the outer panel 26 to the inner panel 16 and/or the intermediate panel 22 may also be desired. The degree of fixity required for the outer panel 26 may also consider the pressure difference across the outer panel 26. In embodiments with an outer panel 26, the outer panel traps 26 mechanically trap the inner panel 22 in place, further reducing the degree of fixity required. The outer panel 26 may be fixed to the intermediate panel 26 with a degree of fixity similar of that of the intermediate panel 22 to the inner panel 16, or may have a greater or lesser degree of fixity. In an embodiment a greater degree of fixity is possible because relative to the inner panel 16, the intermediate panel 22 and the outer panel 26 are relatively thin, and comparable to each other. As a result there may be little thermal fight between the two panels, and this would permit a greater level of fixity between the intermediate panel 22 and the outer panel 26 than between a either of those panels and the inner panel 16.

In an embodiment, portions of a component, such as upstream portions of the Nova-Duct, where the hot gas path velocity is lower and the pressure difference across the wall is also lower, may benefit from the two wall construction, wherein the intermediate panel with the impingement holes are sufficient to drop the pressure for film effectiveness. In such embodiments the outer panel 26 may not cover the entire intermediate panel 22.

The outer panel 26 may include one or more metering holes 28 configured to regulate the flow of cooling fluid into the deformations 40. There may be one or more common flow metering holes 28 for several dimples 40 in the embodiment where the outer panel 26 is set-off from the intermediate panel 22 a small distance. Alternately, when the outer panel 26 is secured to the undeformed portion outer surface 45, there may be one or more unique one flow metering holes 28 for each dimple.

Figure 5:
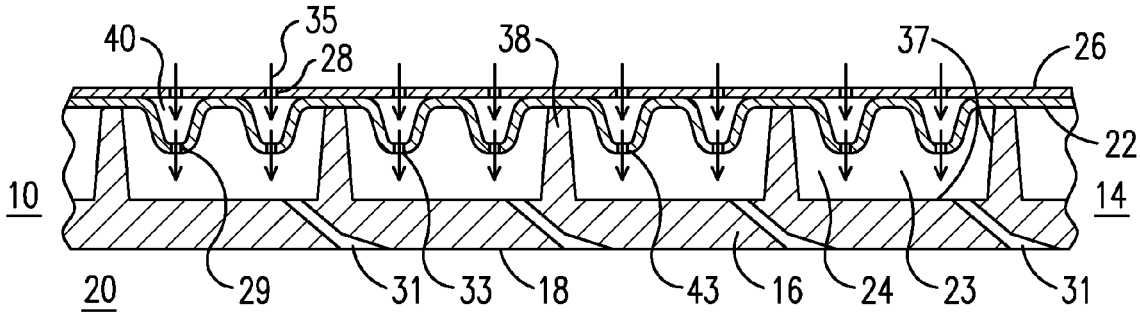
FIG. 5 is an alternate embodiment of the turbine engine component of FIG. 4.

The cooling system formed from a three-layered system is particularly beneficial for the Nova Duct concept, where the pressure drop across the component wall is much higher than in traditional transition ducts. The outer panel 26, which serves primarily as a pressure drop/flow metering device, is especially needed for this type of component. Without the outer panel 26 to accommodate some of the pressure drop across the component wall, the pressure drop across the film cooling hole 31 would be relatively large. As a result, the cooling fluid would flow through the film cooling hole 31 relatively fast and once inside the plenum 20 would separate from the inner surface 18 of the inner panel 16, instead of "adhering" to the inner surface 18 and forming a film of cooling fluid. The metering holes 28 may have any appropriate size, configuration and layout, and may be offset laterally from the impingement holes 29 or aligned axially therewith. When the outer panel 26 is secured to the undeformed portion outer surface 45, there may be a single unique metering hole 28 for each deformation 40, or there may be many unique flow-metering holes 28 for each deformation 40. FIG. 5 depicts an embodiment where there is an outer panel 26 and more than one deformation 40 per pocket 23.

The outer panel 26 may also be formed from a flat sheet of material. The flow metering holes 28 may be formed by various methods known to those in the art. They may be patterned to be centered in the deformation 40, or to be offset. The outer panel may be formed to match a contour of the intermediate panel 22 prior to being secured to the intermediate panel 26, or it may be formed during application. When both the intermediate panel 22 and the outer panel 26 are used, the intermediate panel 22 may be secured to the inner panel 16 first, and then the outer panel 26 may be secured to the intermediate panel 22, and may cover some or the entire intermediate panel 22. Forming of the panels may be prior to or during the securing step. Alternatively, the outer panel 26 may be secured to the intermediate panel 22 first, and then the assembly secured to the inner panel 16. The assembly may be formed to match a contour of the inner panel 16 prior to securing to the inner panel 16, or may be formed while securing the assembly to the inner panel 16. The assemble may cover some or the entire inner panel 16.

In an embodiment with an inner panel 16, an intermediate panel 22 enclosing a pocket 23, and an outer panel 26 regulating flow, cooling fluid disposed outward of the outer panel 26 may flow through the flow metering holes 28, into the deformation 40, through the impingement hole 29, and into the cooling chamber 24. The cooling jet impinges the inner panel outer surface 37 where it cools the inner panel 16. The spent cooling fluid flows about the cooling chamber 24, where some of the spent cooling fluid flowing into a portion of the cooling chamber 24 outward of the impingement hole outlet 33 so it does not interfere (contaminate) the jet 35. All of the spent cooling fluid exits the cooling chamber 24 via the film cooling hole 31, and upon exiting the film cooling hole 31 and entering the plenum 20, the cooling fluid forms a film of cooling fluid between the hot gasses in the plenum 20 and the inner panel inner surface 18, thereby protecting the inner panel 16 from the hot gasses.

This configuration permits a wide degree of flexibility in how the impingement holes 29 may be configured and correspondingly how the inner panel outer surface 37 of the transition duct 12, or any hot gas path component including vane platforms, ring segments (blade outer air seals), combustor liners, etc may be cooled. It does so using existing and simple manufacturing techniques, and as a result the cooling system disclosed herein has been shown to be an easy to implement, easy to perform, and inexpensive solution to a cooling need, and consequently it represents an improvement in the art.

The foregoing is provided for purposes of illustrating, explaining, and describing embodiments of this invention. Modifications and adaptations to these embodiments will be apparent to those skilled in the art and may be made without departing from the scope or spirit of this invention.

The invention claimed is:

1. A method of forming an internal combustion engine hot gas path component comprising a multi-panel outer wall, the multi-panel outer wall comprising an inner panel comprising an inner surface that defines at least a portion of a hot gas path plenum and an outer surface, the inner panel outer surface comprising discrete pockets formed by integral structural ribs, each pocket comprising a film cooling hole permitting fluid communication between the pocket and the plenum, the method comprising:

forming dimples in an intermediate panel, at least one dimple comprising a nozzle;

securing the intermediate panel to the inner panel outer surface, thereby enclosing at least one pocket;

ensuring a respective dimple comprising a nozzle protrudes into a respective enclosed pocket and a respective nozzle is configured to direct a respective jet of cooling fluid onto a portion of the inner panel outer surface within the respective enclosed pocket; and ensuring an outer tip of the ribs contacts the intermediate panel in a part of the intermediate panel free of the dimples.

2. The method of claim 1, comprising bending the intermediate panel so a contour of the intermediate panel matches a contour of the inner panel.

3. The method of claim 1, comprising:

forming a plurality of flow metering holes in an outer panel; and securing the outer panel to an outer surface of the intermediate panel, a respective flow metering hole corresponding to a respective dimple to regulate a respective jet of cooling fluid.

4. The method of claim 3, wherein for each enclosed dimple there is a unique flow metering hole.

5. The method of claim 3, comprising bending the outer panel so a contour of the outer panel matches a contour of the intermediate panel.

6. The method of claim 3, wherein securing the outer panel to the intermediate panel encloses the respective dimple.

7. The method of claim 3, wherein the outer panel encloses fewer than all of the dimples in the intermediate panel.

8. The method of claim 3, wherein a size of the respective flow metering hole is effective to regulate the respective jet of cooling fluid such that the cooling fluid subsequently flowing through the respective film cooling hole forms a film of cooling fluid on the inner panel inner surface during operation of the internal combustion engine.

9. The method of claim 1, wherein the nozzle is configured to direct the respective jet of cooling fluid onto an inter-rib portion of the inner panel outer surface within the respective enclosed pocket.

10. The method of claim 1, comprising forming the respective nozzle such that a respective nozzle outlet is in a portion of the respective dimple closest to a point on the inner panel outer surface at which the respective jet is aimed.

11. The method of claim 1, wherein the respective dimple is centered in the respective enclosed pocket.

12. The method of claim 1, further comprising sealing one pocket from flow from another pocket.

13. The method of claim 1, wherein the respective nozzle outlet is disposed closer to the inner panel outer surface between the ribs of the respective enclosed pocket than to an unindented portion of the intermediate plate.

14. A gas turbine engine component formed by the method of claim 1.

15. A method of forming an internal combustion engine hot gas path component, comprising:

providing an inner panel comprising an inner surface that defines at least a portion of a hot gas path plenum and an outer surface, the outer surface comprising discrete pockets formed by structural ribs, each pocket comprising a film cooling hole permitting fluid communication between the pocket and the plenum;

deforming portions of an intermediate panel to form dimples;

forming a nozzle in the intermediate panel so at least one dimple comprises a nozzle;

securing the intermediate panel to an outer surface of the inner panel and ensuring the at least one dimple comprising a nozzle is disposed in a respective pocket, thereby enclosing the respective pocket; and ensuring the at least one dimple comprising a nozzle protrudes into the respective enclosed pocket and is configured to direct a respective jet of cooling fluid onto a portion of the inner panel outer surface in the enclosed pocket.

16. The method of claim 15, comprising bending the intermediate panel so a contour of the intermediate panel matches a contour of the inner panel.

17. The method of claim 16, comprising:

forming a flow metering hole in an outer panel; and securing the outer panel to an outer surface of the intermediate panel, wherein for each dimple comprising a nozzle there is a respective flow metering hole comprising a size effective to regulate a respective jet of cooling fluid through a respective dimple so that the cooling fluid subsequently flowing through a respective film cooling hole forms a film of cooling fluid on the inner surface.

18. The method of claim 17, wherein for each dimple comprising a nozzle there is a unique flow metering hole.

19. The method of claim 17, wherein the outer panel covers less than all of the dimples.

20. The method of claim 17, comprising bending the outer panel so a contour of the outer panel matches a contour of the intermediate panel.

* * * * *